US005901856A

United States Patent [19]

Brantley, Jr. et al.

[11] Patent Number: 5,901,856

[45] Date of Patent: Apr. 27, 1999

[54] PAPER AND CARDBOARD SEPARATOR WITH INVERTING ROTOR

[76] Inventors: Stanley A. Brantley, Jr., 31154 Millfield Rd., Wakefield, Va. 23888; Junius Warren White, 527 Gliden Rd., Hobbsville, N.C. 27946; Shawn Lane, 209 Oak Leaf Ct. Apt. D, Chesapeake, Va. 23320

[21] Appl. No.: 08/828,410

[22] Filed: Mar. 28, 1997

Related U.S. Application Data

[60] Provisional application No. 60/015,397, Mar. 29, 1996.

[51] Int. Cl.[6] ..... B07B 13/05; B07B 13/07; B07B 13/075

[52] U.S. Cl. ..... 209/672; 209/701

[58] Field of Search ..... 209/655, 657, 209/671, 672, 234, 701; 241/68, 69, 79.3; 493/311, 480

[56] References Cited

U.S. PATENT DOCUMENTS

| | | | |
|---|---|---|---|
| 1,418,899 | 6/1922 | Acken | 209/671 |
| 4,479,581 | 10/1984 | Kelyman | 209/3 |
| 4,679,738 | 7/1987 | Prisco et al. | 209/589 |
| 5,051,172 | 9/1991 | Gilmore | 209/672 |
| 5,232,097 | 8/1993 | Tohkala | 209/234 |

*Primary Examiner*—William E. Terrell
*Assistant Examiner*—Gene O. Crawford
*Attorney, Agent, or Firm*—Raymond L. Greene, Esq.

[57] ABSTRACT

A device for separating office paper and computer printout from cardboard waste material is provided. The device has two decks, each of which has multiple driving and separating disc rotors. Non-cardboard paper can fall between the disc rotors as the paper flows through the machine. A single counter-rotational disc rotor is provided which inverts cardboard and empties boxes. The drive for each deck of the device is independent and variable speed, allowing for quick reconfiguration between input streams.

12 Claims, 8 Drawing Sheets

PAPER AND CARDBOARD SEPARATOR WITH INVERTING ROTOR

UNDERLYING PROVISIONAL APPLICATION

This application is based on Provisional application Ser. No. 60/015,397, filed Mar. 29, 1996 for which the original filing date is claimed.

FIELD OF THE INVENTION

The present invention relates generally to paper recycling devices, and specifically to machines for separating cardboard materials from paper and computer printouts.

BACKGROUND OF THE INVENTION

As environmental concerns have increased over the last thirty years, the need to reprocess paper products received by waste handling companies has intensified. In order to improve efficiency in recycling activities, companies have found it necessary to divide the paper received into several different homogeneous groups. In particular, the separation of cardboard from office paper and computer printout waste is very valuable.

Early efforts at achieving this separation used manual systems. These systems employed slow moving conveyors of five to six feet in width for moving waste through a work area. Workers positioned along a conveyor could then manually remove cardboard and place it in a separate container. These types of systems have many drawbacks. First, the systems are extremely slow, constrained by the limitation of human labor that can be concentrated around the line. Second, the quality of separation depends upon the diligence of the human labor employed. As with many repetitious jobs, some degree of "missed" cardboard results. Third, the size of the line system is quite large, requiring a very wide belt and a full work area around it. Finally, the system was not easily reconfigurable to handle higher or lower throughput demands.

The mechanization of the manual system addressed some of these drawbacks. Current machines have included a configuration of a series of rotors. These rotors move the waste stream along. As the stream moves, paper products fall through the rotors, separating the paper from the cardboard. With these machines, the reliance element on human labor has been reduced. This reduction has vastly increased the speed of the system and decreased the dedicated work space required. However, machines have also increased some of the problems of the manual system. Particularly, current machines are typically not as reliable in their separation as manual labor. In current machines, the low quality of separation continues to require manual monitoring of the output for missed cardboard or paper. Beyond raw separation problems, current rotor based machines have also been ineffective in separating paper which rests on top of a piece of cardboard. For example, a sheet of cardboard may pass over the rotors of the separating machine with a large stack of accordion-style computer paper sitting on the cardboard. The entire stack, perhaps thousands of sheets, rides on the cardboard to the end of the disc rotors to be dumped on the cardboard discharge pile. A similar problem exists with cardboard boxes having paper inside the boxes. Although paper is intended to drop through the separating disc rotors, in this case, the box, with all the paper inside, is carried to the cardboard discharge pile. Additionally, prior art separator machines are typically configured for a specific type of operation and cannot be easily adapted to changes in the mix of paper and cardboard in the input stream. Finally, prior art rotor machines have been subject to mechanical failure due to binding of paper from the input stream around either the rotors or the rotor bearings. A means is needed to remove paper from the top of cardboard sheets and to remove paper from the interior of cardboard boxes.

SUMMARY OF THE INVENTION

Accordingly, it is an object of the present invention to provide an automated, high-speed mechanized system for separating cardboard products from office paper and computer printout.

A further object of the present invention is to provide reliable separation of office paper and computer printout materials riding on top of cardboard.

A still further object of the present invention is to provide for the emptying and separation of boxed materials.

A still further object of the present invention is to provide adjustable speed operation which can be adapted to both the flow of input material and the mix of cardboard and paper within the input stream.

A still further object of the present invention is to provide for a rotor system which reduces the wrapping and binding of input material around the rotors and rotor bearings.

In accordance with these and other objects, the invention is a paper separator having two decks with a series of disc rotors. The relative alignment of the discs and the shape and size of the discs are selected to provide efficient separation of paper products without binding. Following the first deck, at the discharge end of the first series of disc rotors, a single inverting rotor driving against the flow of the input material catches the input material and inverts it. This process allows the complete separation of the cardboard and office paper to occur in the second deck. The inverting rotor also bursts any intact cardboard boxes, office paper and computer printouts fall between the discs and are collected, cardboard rides along the top of the discs and is passed out of the machine at one end. The discs of the two deck stages are driven by variable speed motors, and the inverter discs are driven by a separate variable motor. Alternatively, fixed speed motors may be used. This configuration allows the speed of the discs to be adjusted based on the mixture and throughput of the input material.

BRIEF DESCRIPTION OF THE DRAWINGS

The foregoing objects and other advantages of the present invention will be more fully understood from the following detailed description and reference to the appended drawings wherein.

DESCRIPTION OF THE PREFERRED EMBODIMENT

Figure 1:
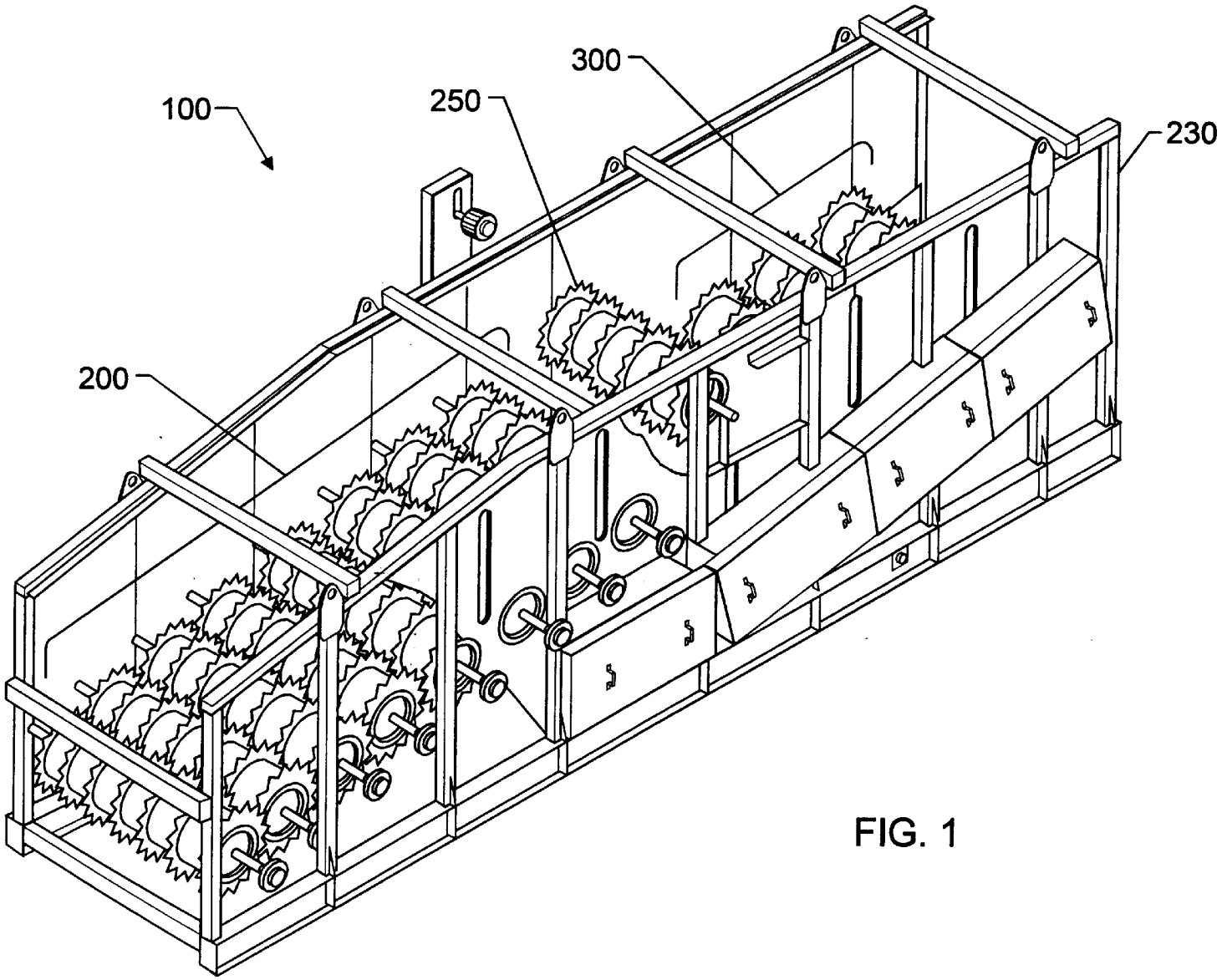
FIG. 1 is a perspective view of the paper separator.

Referring now to FIG. 1, the overall paper and cardboard separator 100 is shown with its major components. The frame 230 is covered on both sides by steel plates, shown here in partial cutaway to illustrate the rotor decks. Attached to the frame 230 are rotor decks 200 and 300. At the discharge end of the upper rotor deck 200, the counter-rotating disc rotor 250 is located (spaced a short distance away from the discharge end of the upper deck).

Figure 2:
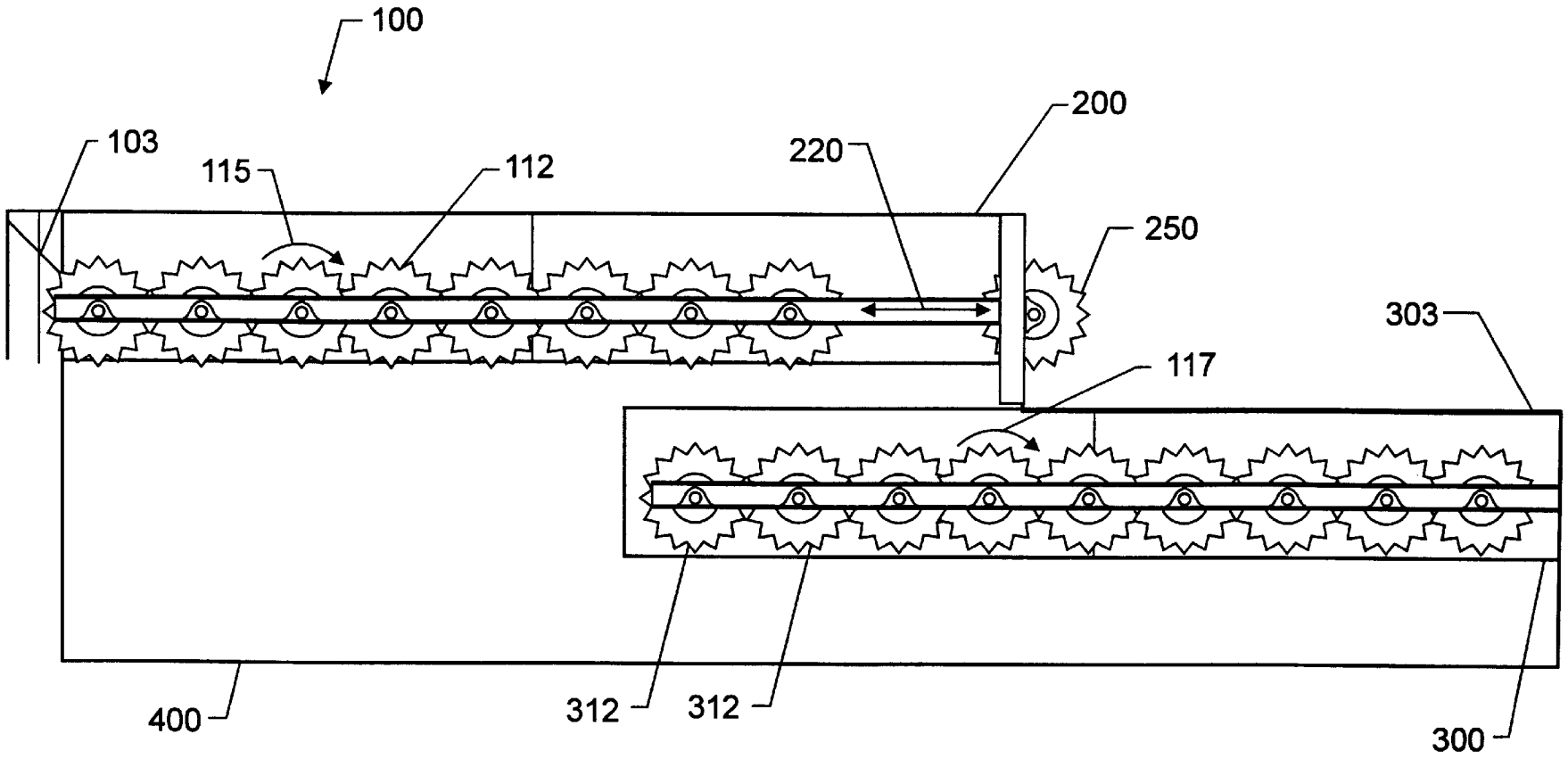
FIG. 2 is a side view diagram of the rotor configuration.

Referring now to FIG. 2, the paper and cardboard separator 100, is shown as a two level device having an upper deck 200 and a lower deck 300. Each deck has a series of rotating, separating disc rotors. The upper deck 200 has a first series of disc rotors 112 each rotating in a clockwise direction as indicated by arrows 115. Separate counter-rotating disc rotor 250 is located at the end of the first series, but is spaced away from the first series by an upper gap 220. The lower deck 300 also contains a series of rotating, separating disc rotors 312 also turning in a clockwise direction as indicated by arrows 117. Paper products enter paper and cardboard separator 100 through separator intake 103. In practice, a conveyor belt system may be used to move paper products from external collection areas to the separator intake 103. Once paper products enter paper and cardboard separator 100, the rotation of disc rotors 112 moves the paper products deeper into paper and cardboard separator 100. Disc rotors 112 are roughly circular in shape with each disc having a series of equally-spaced points around the edge of the disc. The number, dimension and shape of the points effects the operation of paper and cardboard separator 100. As disc rotors 112 turn, the points tend to grip the paper products and move them along from left to right in the figure. Non-cardboard paper products (office paper and computer printout) are sufficiently small or sufficiently flexible to allow these paper products to slide between the gaps in disc rotors 112. These paper products fall through the open interior of paper and cardboard separator 100 and onto the collection belt 400. The collection belt 400 moves along the bottom of paper and cardboard separator 100 and moves computer printout and office paper products from paper and cardboard separator 100.

If computer printout and office paper products are riding on top of cardboard products (or within a box), the action of disc rotors 112 is not likely to dislodge and separate that paper. In order to separate these materials, the present invention uses a counter-rotating disc rotor 250. Counter-rotating disc rotor 250 is an independently driven, disc rotor which turns in the opposite direction of disc rotors 112. As cardboard products reach the end of the series of disc rotors 112, they sail across upper gap 220 and collide with counter-rotating disc rotor 250. The movement of counter-rotating disc rotor 250 causes the cardboard products to be abruptly stopped and inverted. This inverting effect spills the contents of boxes and flips over single cardboard sheets such that paper products previously on top can then fall off. The inverted stream of cardboard falls through upper gap 220 and into lower deck 300.

The flow of the paper products through lower deck 300 is analogous to that of upper deck 200. The disc rotors 312 turn clockwise, pulling the cardboard and paper stream from left to right of paper and cardboard separator 100. As the paper products move across disc rotors 312, office paper and computer printouts again fall between the discs on disc rotors 312, through the open interior of paper and cardboard separator 100 and onto collection belt 400. At the end of lower deck 300, the remaining cardboard products are ejected from paper and cardboard separator 100 through separator output 303. In normal operation, conveyor belts are connected to the ends of both separator output 303 and collection belt 400 to move the separated materials to separate processing areas within the facility.

The disc rotors 312 can be the same or different configuration from disc rotors 112, The movement of disc rotors 312 is controlled by a separate motor, which allows for a variance in the speed of operation between upper deck 200 and lower deck 300. This variance in speed is useful since the composition of the paper product stream (in terms of the amount of office paper and computer printouts relative to the amount of cardboard) usually varies between the two decks. Independent adjustment of the operating speeds allows for optimal separation of the paper product stream in each deck.

Figure 3:
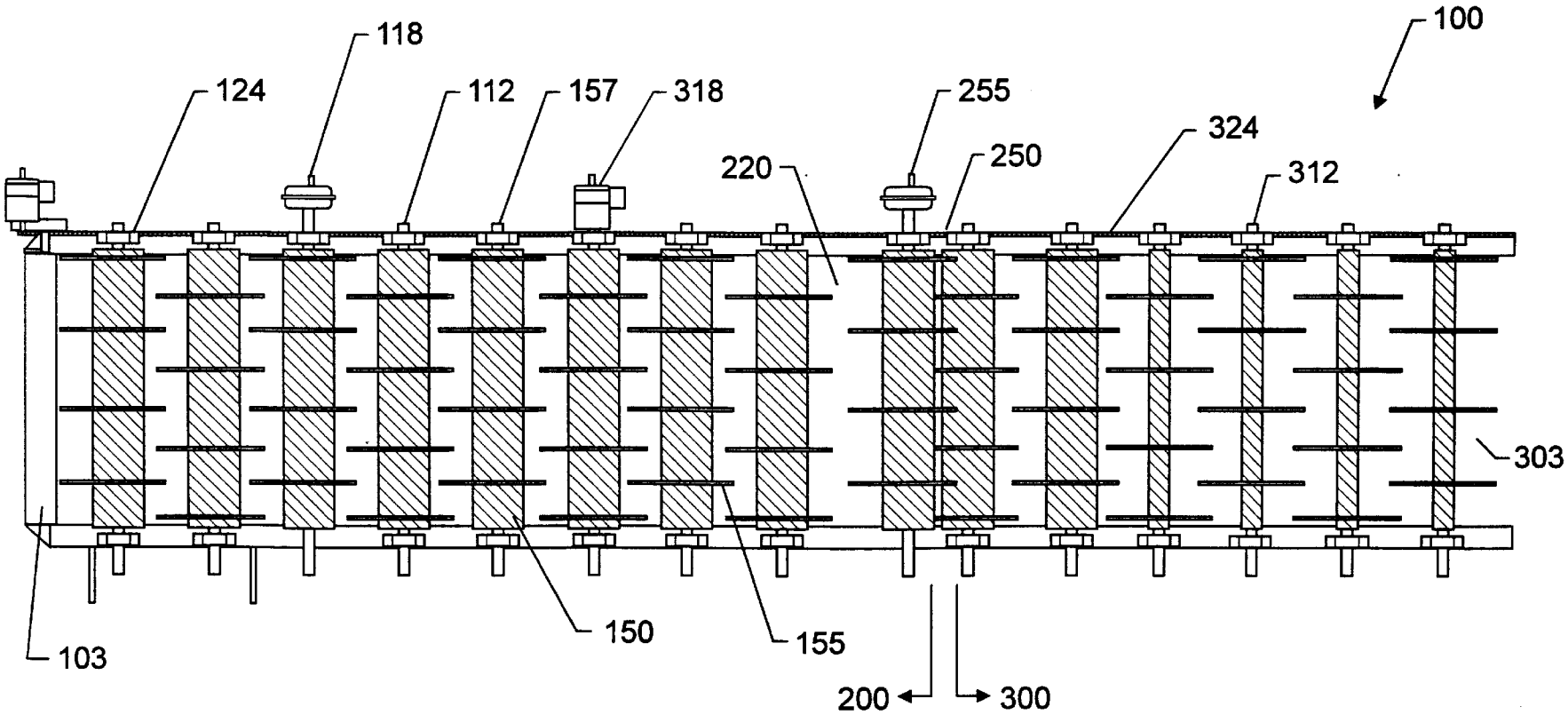
FIG. 3 is a top view diagram of the present invention.

Referring now to FIG. 3, a top view of paper and cardboard separator 100 is provided. In this view, paper products enter paper and cardboard separator 100 through separator intake 103 at the left side of the drawing. The paper product stream is moved along by the rotation of disc rotors 112. Each disc rotor has a solid disc shaft 150 which has multiple disc blades 155 attached to it. Disc blades 155 are formed in a distinctive star shape as seen from the side. Other shapes may be sculptured for different types of waste. Through the center of disc shaft 150 extends disc axle 157. The disc axle 157 of each disc rotors 112 is attached to deck drive chain 124. Drive chain 124 is, in turn, connected to deck motor 118. Thus, deck motor 118 is able to turn the entire series of disc rotors 112 in a synchronized fashion.

Counter-rotating disc rotor 250 is the divider between upper deck 200 and lower deck 300. As paper products reach counter-rotating disc rotor 250, they are inverted and dropped through upper gap 220 into lower deck 300. Counter-rotating disc rotor 250 is constructed in a similar fashion to disc rotors 112; however, counter-rotating disc rotor 250 is not connected to a drive chain, The motive force for counter-rotating disc rotor 250 is provided by counter-rotating motor 255, an independent dedicated motor.

Lower deck 300 is similar to deck 200. Rotation of disc rotors 312 is accomplished through a separate chain drive, lower deck drive chain 324 which is connected to lower deck motor 318. Cardboard which makes it through the entire process exits paper and cardboard separator 100 by way of separator output 303.

Figure 4:
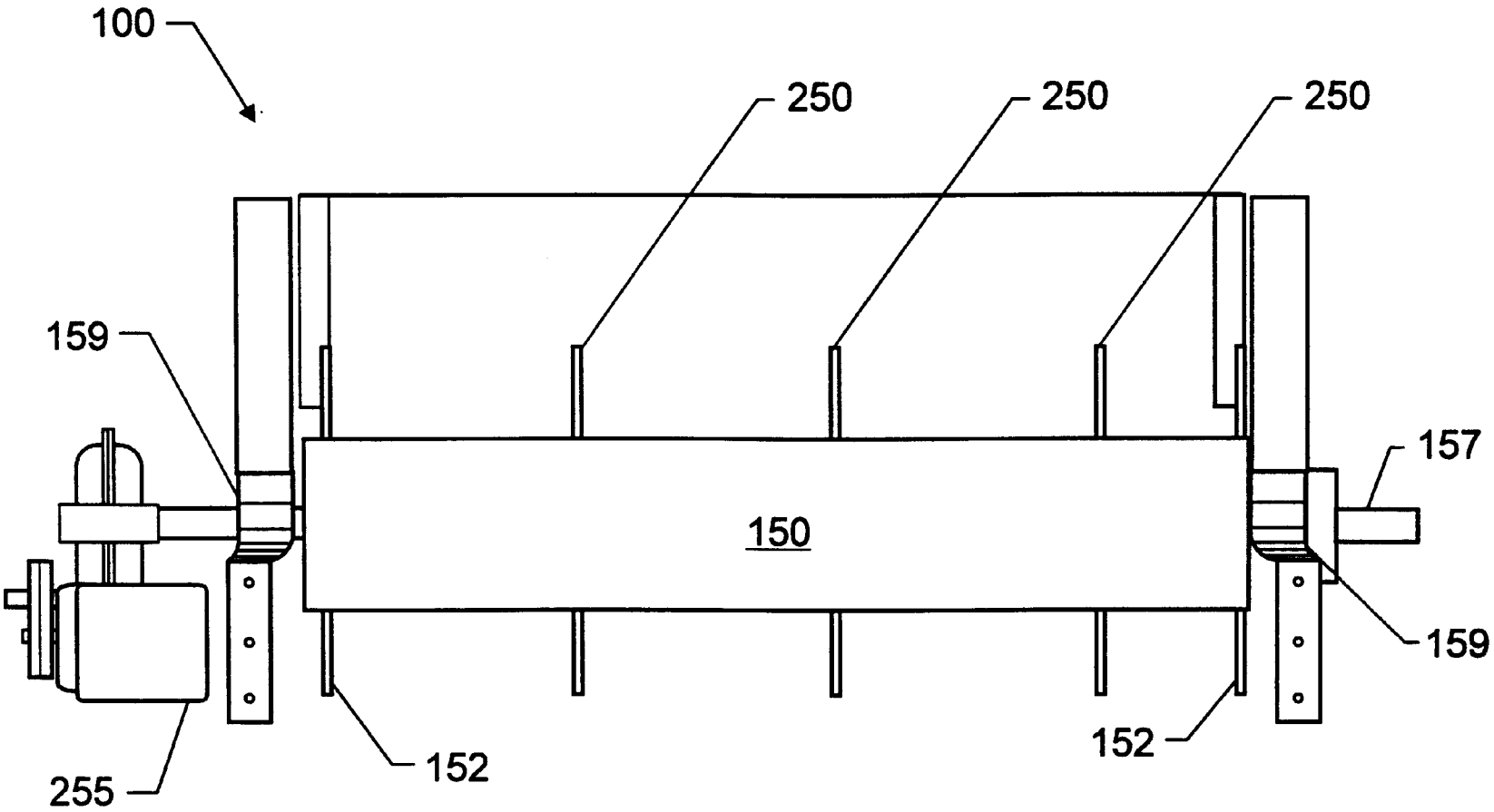
FIG. 4 is an end view of the adjustable rotor assembly.

Referring now to FIG. 4, a detailed end view of counter-rotating disc rotor 250 is provided. Disc axle 157 extends through the wall of paper and cardboard separator 100 and is attached through bearings 159 or similar means which allows for free rotation of disc axle 157 relative to the wall. A bearing protector 152 provides a shield for bearing 159 from paper flow. In this way, paper debris is less likely to bind the movement of disc axle 157. Disc axle 157 is rigidly attached to disc shaft 150. Discs are rigidly fixed to disc shaft 150. Thus, rotation of disc axle 157 rotates both disc shaft 150 and discs. The rotation of disc axle 157 is provided by counter-rotating motor 255. Although this figure depicts counter-rotating disc rotor 250, the construction of disc rotors 112 and disc rotors 312 is similar.

Figure 5:
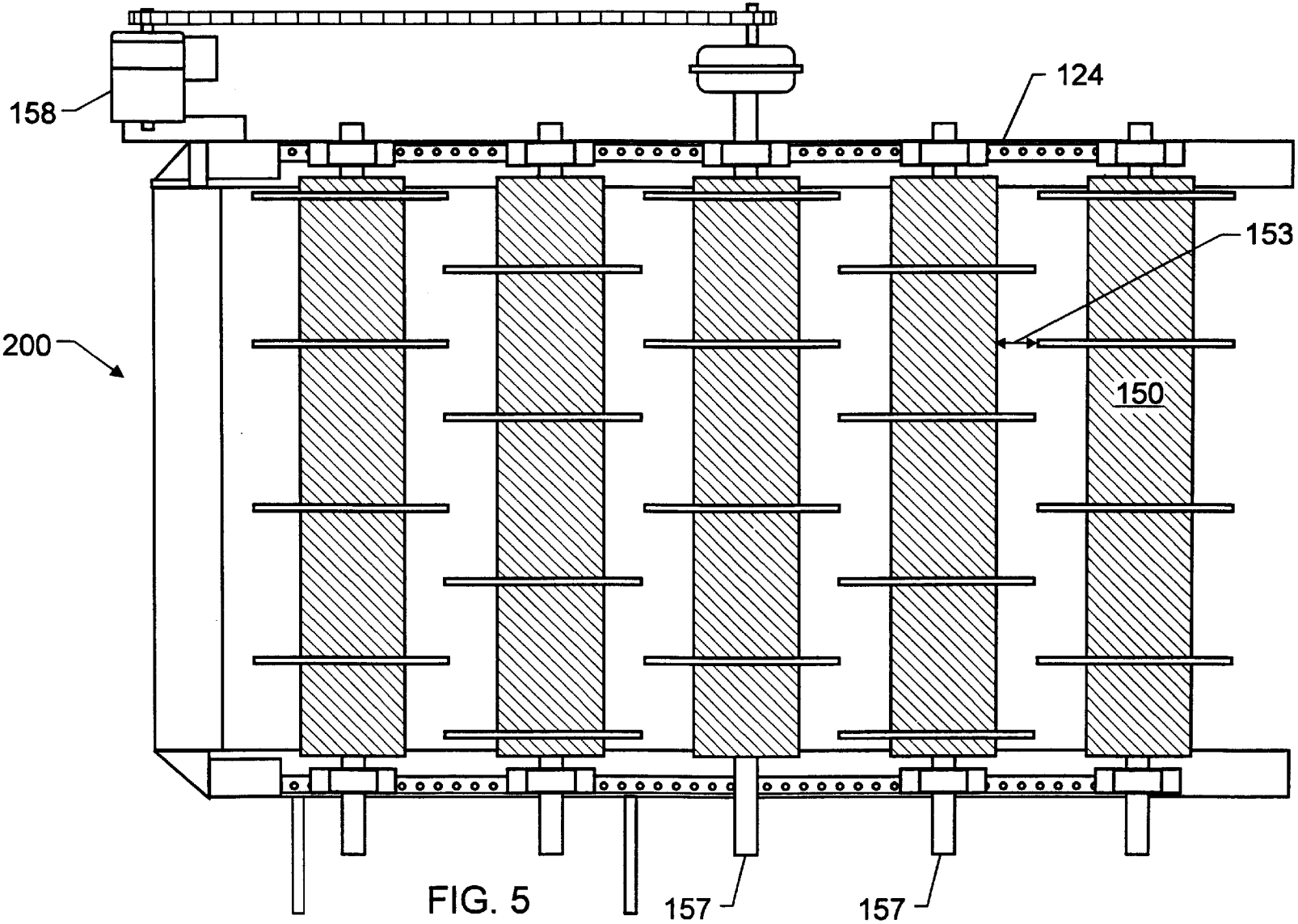
FIG. 5 is a detailed top view of a section of the separator.

Referring now to FIG. 5, a detailed view of upper deck 200 is provided. This figure depicts the relative spacing and proportion of the preferred embodiment. The relative distance 153 between the outer edge of each disc blade and the shaft 150 (the adjacent disc shaft) is depicted showing typical sizes for efficient pass-through of white paper and office paper with a minimum of entanglement and wrapping around the shafts. The figure also depicts the relative distance and spacing between the centerline of disc axles 157. Gearbox 158 is shown for reference connected to drive chain 124.

Figure 6:
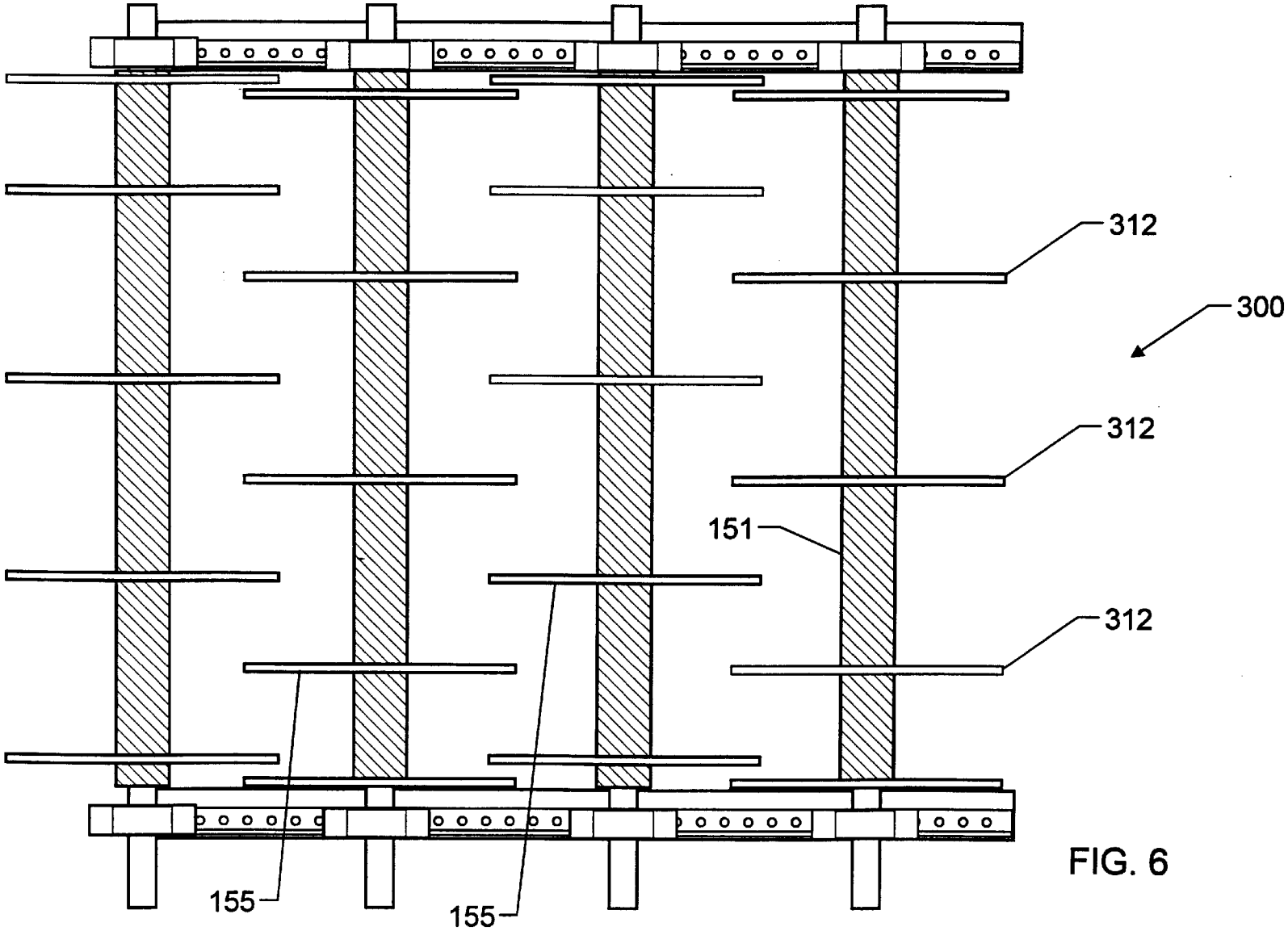
FIG. 6 is a detailed top view of a section of the separator showing the adjustable feature of the discs.

Referring now to FIG. 6, a detailed view of lower deck 300 is provided. This figure shows the relative horizontal and vertical spacing between disc blades 155 in more detail for the preferred embodiment. As shown, the total width of lower deck 300 is approximately seven feet. A series of disc rotors 312 are provided, shown on axles without disc shafts or with smaller disc shafts 151. This configuration provides an alternate embodiment wherein the nature of the waste products does not require as much protection from entanglement and binding and therefore it is possible to use open axle shafts on the final portion of the separation (on the second deck).

Figure 7:
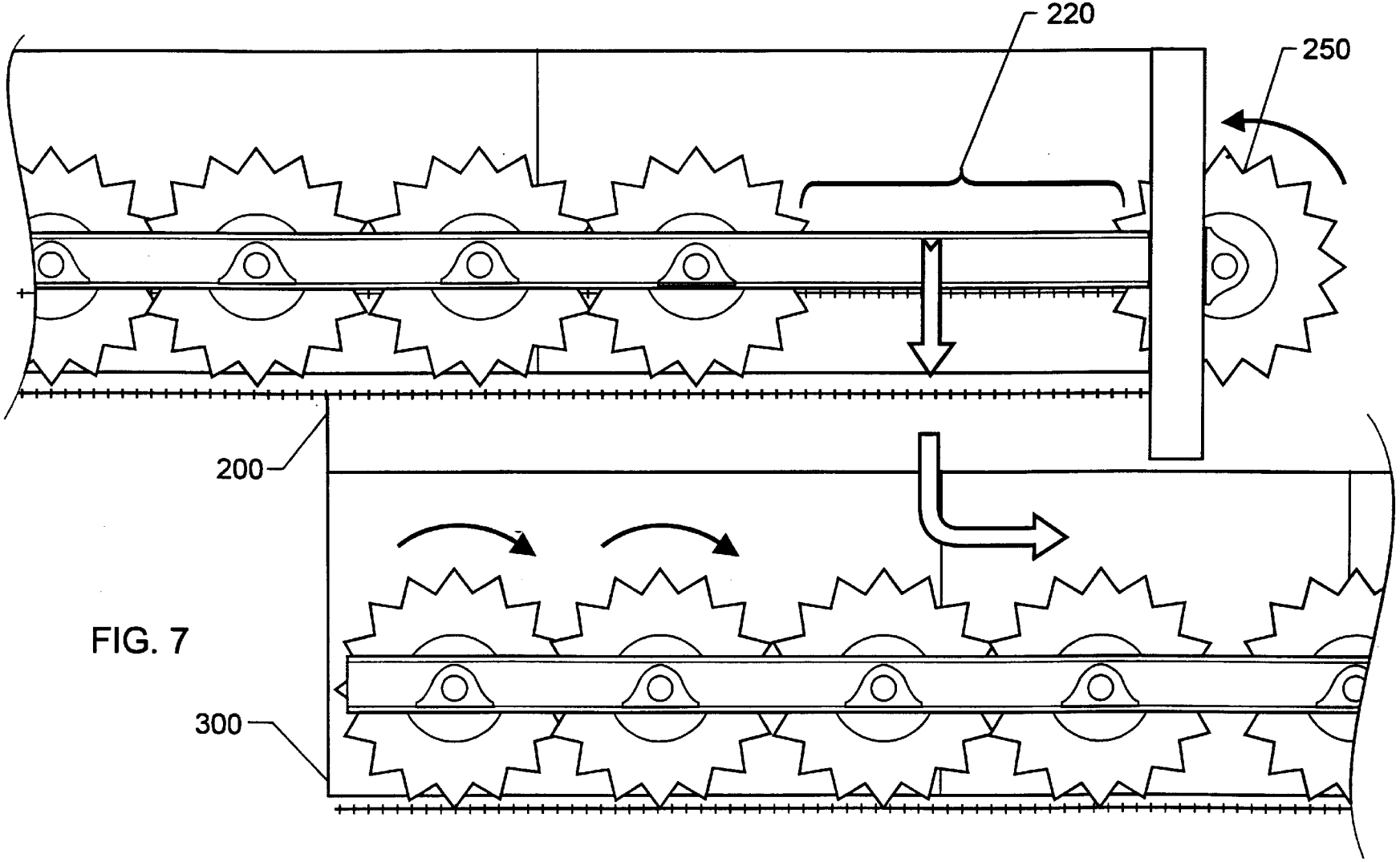
FIG. 7 is a detailed side view of the interface between the first and second stage of the separator.

Referring now to FIG. 7, a detailed side view of the interface between upper deck 200 and lower deck 300 is presented. This figure shows upper gap 220 in detail. Aligned with the discharge end of upper deck 200, following upper gap 220, is the counter-rotating disc rotor 250.

In the preferred embodiment of the present invention, the overall size of the system is approximately thirty feet in length by ten feet in width. The separating system has two main rotor deck sections which overlap each other by approximately eight feet. Each rotor deck section is driven by a TEFC 3 phase, electric motor by a gearbox and #100 drive chain. Alternative drive mechanisms can be substituted, however it is necessary to provide an adjustable drive mechanism (so that the rotor section may be moved vertically up and down) for the counter-rotating disc rotor. Also, the rotor design provides large diameter (approximately 2½ feet) sculptured steel blades mounted on each rotor.

OPERATION OF THE INVENTION

Figure 8:
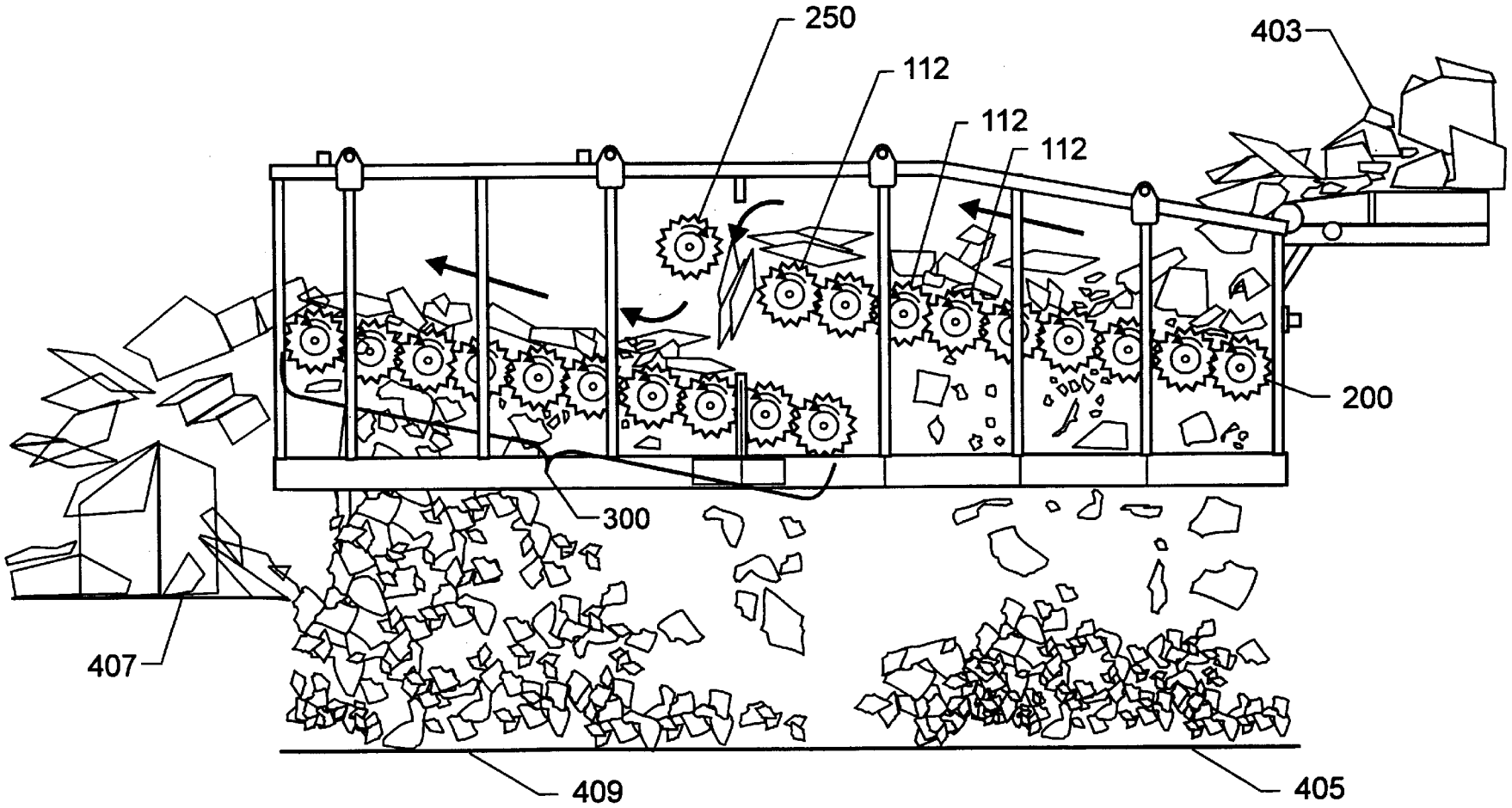
FIG. 8 is a side view diagram of the paper separator showing operation of the machine.

Referring now to FIG. 8, the operation of the invention is shown. The cardboard/paper mixture 403 is loaded into the separator at the input end of the upper deck 200. The disc rotors 112 turn in the direction (as shown) to move the mixture along the disc rotors from right to left. During this movement, cardboard and similar materials continue on top of the disc rotors toward the inverting disc rotor 250. Office paper, computer printouts, and other loose paper 405 begins falling through the rotors. However, cardboard boxes containing paper or large sheets of cardboard (which have office paper lying on top) can carry the office paper across the rotors toward the cardboard stack 407. In order to preclude office paper being carried in this manner, the counter-rotating disc rotor 250 flips over large sheets of cardboard and also bursts any cardboard boxes. Thereafter, the process continues on the lower deck 300 against separating the office paper 409, which falls through the rotors, while moving the cardboard to the separated cardboard stack.

The features and advantages of the present invention are numerous. The present invention provides a mechanized system for sorting office paper and computer printout from cardboard products. Operation of the present invention with the inverting disc rotor produces an output cardboard product with considerably less paper contamination by allowing the system to separate paper products riding on top of cardboard as well as those inside boxes. This effect is not achieved when the system does not have an inverting disc rotor.

The use of three separate, variable-speed, drive motors provides the system with the ability to be dynamically configured for operation at different speeds in each stage. Variable speed motors allow adjustment of the operating speed of each deck, thus allowing the system to be reconfigured for use with a wide variety of input paper mixes. Alternately, fixed speed motors may be used for specific types of waste material.

The use of the bearing protector provides the system with the ability to prevent binding of paper products around the axles at the bearing location of the system, thus enhancing bearing operation life, thereby lessening maintenance. The disc separation system is a heavy duty design having high performance and long service life with minimal wear and maintenance.

It will be understood that many additional changes in the details, materials, steps, dimensions, and arrangement of parts, which have been herein described and illustrated in order to explain the nature of the invention, may be made by those skilled in the art within the principle and scope of the invention as expressed in the appended claims:

What is claimed is:

1. A paper and cardboard separator system comprising:

a frame;

an upper deck having a first plurality of disc rotors rotatably attached to said frame each disc rotor having a plurality of disc blades fixed thereto, such blades having a spacing and circumferential shape to pass office paper through said deck and to carry cardboard containers along said deck;

first means for rotating said first plurality of disc rotors rotatably attached to said frame and movably attached to said first plurality of disc rotors;

a lower deck having a second plurality of disc rotors rotatably attached below said deck to said frame each disc rotor having a plurality of disc blades fixed thereto, such blades having a spacing and circumferential shape to pass office paper through said deck and to carry cardboard containers along said deck;

second means for rotating said second plurality of disc rotors rotatably attached to said frame and movably attached to said first plurality of disc rotors;

a counter-rotating disc rotor having a plurality of disc blades attached to said frame beyond the discharge end of said upper deck and above said lower deck, rotating counter to said first plurality of disc rotors and adapted to burst cardboard containers; and a motor attached to the frame and connected to and driving said counter-rotating disc rotor.

2. A paper and cardboard separator system as in claim 1 wherein said disc axle has a bearing protector rotatably attached to said disc shaft.

3. A paper and cardboard separator system as in claim 1 wherein said first means for rotating further comprises a motor attached to said frame and a drive chain movably attached to said motor and said first plurality of disc rotors.

4. A paper and cardboard separator system as in claim 1 wherein said second means for rotating further comprises a motor attached to said frame and a drive chain movably attached to said motor and said second plurality of disc rotors.

5. A paper and cardboard separator system as in claim 1 wherein said motor for said counter-rotating disc rotor is a variable speed, independent, dedicated motor.

6. A paper and cardboard separator system as in claim 1 wherein said motor for said counter-rotating disc rotor is a fixed speed, independent, dedicated motor.

7. A paper and cardboard separator system as in claim 1 wherein said disc blades are sculptured.

8. A paper and cardboard separator system as in claim 1 wherein:

said first means for rotating further comprises a first motor attached to said frame and a first drive chain movably attached to said first motor and said first plurality of disc rotors; and said second means for rotating further comprises a second motor attached to said frame and a second drive chain movably attached to said second motor and said second plurality of disc rotors.

9. A paper and cardboard separator system as in claim 8 wherein said first and second motors are variable speed, independent, dedicated motors.

10. A paper and cardboard separator system comprising:

a frame;

an upper deck attached to said frame and having a first plurality of disc rotors attached to said frame using a disc axle, having a disc shaft surrounding and affixed to said disc axle, a plurality of disc blades attached to said disc shaft, such blades having a spacing and circumferential shape to pass office paper through said deck and to carry cardboard containers along said deck a plurality of bearing protectors attached to said disc shaft, and a plurality of bearings providing a frame-axle connection;

a first motor attached to said frame;

a first drive mechanism movably attached to said first motor and said first plurality of disc rotors;

a lower deck attached to said frame and having a second plurality of disc rotors attached to said frame using a disc axle, having a disc shaft surrounding and affixed to said disc axle, a plurality of disc blades attached to said disc shaft, such blades having a spacing and circumferential shape to pass office paper through said deck and to carry cardboard containers along said deck a plurality of bearing protectors attached to said disc shaft, and a plurality of bearings providing a frame-axle connection;

a second motor attached to said frame;

a second drive chain movably attached to said second motor and said second plurality of disc rotors;

a counter-rotating disc rotor having a plurality of disc blades attached to said frame spaced beyond the discharge end of said upper deck and above said lower deck and rotating counter to said first plurality of disc rotors and adapted to burst cardboard containers; and a third motor attached to said frame and connected to and driving said counter-rotating disc rotor.

11. A paper and cardboard separator system as in claim 10 wherein said first, second and third motors are variable speed and independent.

12. A paper and cardboard separator system as in claim 10 wherein said first, second and third motors are fixed speed and independent.

* * * * *